United States Patent [19]

Belot

[11] Patent Number: 4,628,971

[45] Date of Patent: Dec. 16, 1986

[54] APPARATUS FOR THE VOLUMETRIC DOSING OF POWDER

[75] Inventor: Jean Belot, Cusset, France

[73] Assignee: Manufacture de Machines du Haut-Rhin, Mulhouse, France

[21] Appl. No.: 688,019

[22] Filed: Dec. 31, 1984

[30] Foreign Application Priority Data

Dec. 29, 1983 [FR] France ..... 83 21004
Nov. 16, 1984 [EP] European Pat. Off. ..... 84-402339.0

[51] Int. Cl.[4] ..... B65B 1/04
[52] U.S. Cl. ..... 141/67; 141/345
[58] Field of Search ..... 141/67, 345, 1-12, 141/37-66, 68-70, 250-284, 98, 331-344

[56] References Cited

U.S. PATENT DOCUMENTS 3,656,517 4/1972 Taylor et al. ..... 141/67

*Primary Examiner*—Houston S. Bell, Jr.

[57] ABSTRACT

Apparatus for the volumetric dispensing of powder and introducing the same in predetermined doses into hollow objects. A drum is mounted for continuous rotation around the vertical axis of a shaft. An annular channel for the reception of powder is disposed about the drum coaxially thereof, the drum carrying a plurality of stations for the reception of hollow objects so as to position the objects vertically with their open ends upwardly. Between the annular channel and each article receiving station, by means of purely mechanical mechanisms, there are provided and controlled a powder retaining probe of the type which can be subjected to sub-atmospheric pressure, carried in a moveable manner upon the drum. The volumetric powder dose determining and dispensing apparatus of the invention is particularly adapted for the handling of explosive powder.

10 Claims, 3 Drawing Figures

73
64
54
II
34
17
18
2
20
14
22
21
39
40
35
II
41
37
36
38

24
23
29
74
26
22
25
21
28
27
72
18
52
54
53
57
59
58
55
B
29
74
A
22
23
21
56
18
54
C
52
57
59
46
D
45
42
56
34
49
43
44
47
48
32
31
30
33

1
2
3
4
5
6
7
8
9
10
11
12
13
14
15
16
17
18
19
20
21
22
23
25
26
29
30
34
41
42
50
51
52
54
60
61
62
63
64
65
66
67
68
69
70
71
73

APPARATUS FOR THE VOLUMETRIC DOSING OF POWDER

The present invention relates to an apparatus for the volumetric dosing of powder and the introduction of predetermined doses thereof into receptacles.

The invention is more particularly concerned with the precise dosing of pulverized granular compositions, hereinafter "dosing" of pulverized granular "compositions", hereinafter "powder", the handling of which entails substantial risk (sensitivity to friction and shock), and to the automatic transfer of measured powder doses into hollow articles, and to do so without substantial loss of powder.

Among the pulverized or granular compositions of such types are conventional incendiary compositions constituted by a mixture of metallic salts and metallic powders the dispensing of which and the introduction thereof into cartridge cases involves particular conditions of manipulations in order totally to avoid the risk of explosion, notably the absence of inopportune formation of any cloud of dust or the deposition of ultrafine particles upon the apparatus being used or upon neighboring apparatus.

Apparatus most widely currently in use for dispensing such compositions employ the principle of the dosing drawer, which presents the inconvenience of generating friction which is not negligible, in the presence of compositions which are particularly sensitive to friction or pressure. This particularly involves a permanent danger of the creation of an ignition of the powder either by pressure or by friction, as well as also by rubbing. On the one hand, the transfer of the dosed composition into the hollow objects to be charged is generally accompanied by a release of dust, which is prejudicial to security, by the soiling of the machines upon which the apparatus is employed, as well as by the risk of formation of an explosive atmosphere by diffusion therein of combustible particles in suspension.

Further, the presence of dust in the atmosphere or the environment is not, generally, permissible under the environmental rules relative to working conditions.

Finally, such apparatus are only difficulty employed in manufacturing lines otherwise fed, and particularly those continually fed and discharged while continuously in motion, by reason of the slow speed in production which causes an important advantage of continuous production to be lost.

There also exist apparatus for the automatic weighing of powder, but these are not generally employed by reason of the serious absence of protection of such apparatus against risks arising by reason of electricity, and also, equally, by their relative slow speed in production; their employment in continuously moving mechanism otherwise presents difficult problems which are difficult if not impossible to solve.

The present invention has among its objects the provision of an apparatus for the volumetric dosing of a powder, wherein one intends generally by "powder" a pulverized granular composition, and the introduction of predetermined doses of such powder into hollow articles, such dosing apparatus being adapted to be integrated into a manufacturing line which is fed and discharged while in continuous motion, such apparatus yielding a good precision of dosage, with total security and without any substantial emission of dust.

Powder dosing apparatus in accordance with the invention are characterized by the following:

a drum mounted for rotation about a vertical axis on a shaft, means for drivingly rotating the drum with respect to the shaft about such axis, in a predetermined direction, an annular channel for receiving powder, such channel being open at the top, and being in the form of a solid of revolution coaxial with the axis of rotation of the drum, means for feeding powder into the annular channel to maintain the level of the powder in the channel, a predetermined number of receiving stations, each for the reception of an object to be charged occupying a position in which an opening thereof is directed upwardly and positioned on a predetermined vertical axis, said receiving stations being fixed with respect to the drum and uniformly annularly spaced about the axis of rotation thereof, forming a ring about such axis, and disposed nearer to it than the channel, a feeding post for feeding the receiving stations with objects occupying the said position, said feeding post being fixed with respect to the shaft, a discharging post for discharging the objects from the receiving stations, such discharging post being fixed with respect to the shaft, the same predetermined number of powder-dispensing probes of known vacuum-drawing type carried in a movable manner upon the drum and disposed according to a predetermined orientation in which each presents toward the bottom a powder-retaining dispensing orifice having a vertical axis, each of said probes being associated with a receiving station, means for displacing each of the probes with respect to the drum, separately and cyclically in synchronism with the rotation thereof with respect to the shaft, according to a fixed trajectory with respect to the drum and leading the dispensing orifices of said probe systematically into the following successive positions:

(a) a first lower position in which the dispensing orifice plunges into the channel, the probe then occupying an angular position with respect to the shaft, with reference to the axis of rotation of the drum, different from that of the means for feeding the powder to the channel, (b) a first upper position in which said dispensing orifice is positioned straight above the channel, (c) a second upper position in which said dispensing orifice is placed coaxially with respect to the opening of an object occupying said position in the receiving station associated with said probe, the said orifice and the said opening being separated, (d) a second lower position in which said dispensing orifice is disposed coaxially with the pending of said object and in communication therewith, said receiving station being then moved from the feeding post toward the discharging post by reason of the rotation of the drum with respect to the shaft, (e) said receiving station being then moved back into the second upper position, and (f) said receiving station being moved back into the first upper position, means for causing a sub-atmospheric pressure in said dispensing orifice in position (a) and from position (a) to position (d) thereof, and cutting off said sub-atmospheric pressure in position (d) and from position (d) to position (a).

Advantageously, the drum carries at least means for tightly connecting the dispensing orifice of a probe and the opening of an object in position (d) of the orifice of the probe, and means to establish a sub-atmospheric pressure in the object in the said position (d) of the dispensing orifice of the probe.

The annular channel for the reception of powder can be fixed to the drum or driven in rotation about the axis of rotation of the drum at a speed different from that of the drum, by reason of specific means for driving it. As a variant, the annular channel may be fixed with respect to the shaft.

By preference, the means for feeding the annular channel with powder comprises a hopper opening inside the channel, driving means being provided to assure a circular displacement coaxial with the axis of rotation of the drum, between the channel and the hopper.

It is to be noted that the orifice of the hopper and the annular channel cooperate to ensure the continuous arrival of powder fed from said hopper, so as to ensure the permanent existence in the channel of a homogeneous band of powder having constant height or level; the utilization of a vacuum-drawing type of dispensing probe furthermore permits to avoid the risks of explosion and of segregation of the powder during the drawing thereof in the channel as well as during the transfer thereof to the object; since, in a preferred manner, such means are provided to assure a tight fit between the latter and the probe at the moment of transfer of powder, and the establishment of the sub-atmospheric pressure in the object to facilitate such transfer, all emission of dust is practically excluded.

Furthermore, the apparatus can be controlled by means of an exclusively mechanical control means, particularly by cams and distributors, to the exclusion of all electrical means which would provide a risk of explosions when the powder being dosed is explosive.

There is thus produced a combination of conditions which is totally advantageous, in an apparatus which can be easily integrated into a production chain to which objects to be dosed can be fed and from which they can be discharged while the chain is continuously in motion.

Other characteristics and advantages of the mechanism in accordance with the invention will appear from the following description, relative to a non-limiting manner of carrying the invention into effect considered actually as preferred, as well as the supplemental drawings which form an integral part of such description.

In the drawings:

FIG. 3A is a view in vertical axial section through the lower end of the powder-feeding hopper disposed in juxtaposition relative to the upwardly open annular powder-retaining channel;

Figure 3:
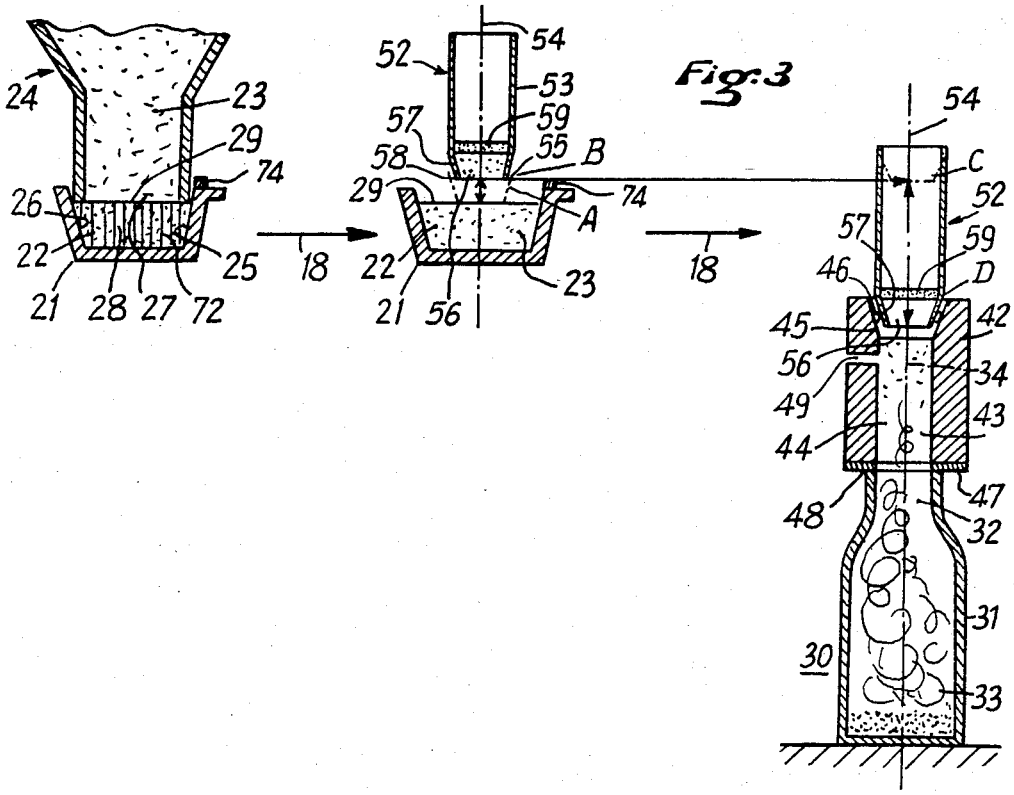
FIG. 3 is a composite view made up of sub-views A, B, and C, such parts being in the nature of a time-graph, and showing elements of the apparatus in the positions which they assume in sub-view A, somewhat later in sub-view B, and finally in sub-view C. Such sub-views will be referred to hereinafter as FIGS. 3A, 3B, and 3C, respectively.

FIG. 3B is a fragmentary view in vertical axial section through a probe spaced somewhat above the annular powder-retaining channel, the probe having taken a dose of powder from the channel and risen with such dose retained therein by the the channel and risen with such dose retained therein by the powder-retaining orifice; and FIG. 3C is a fragmentary view in vertical axial section through a probe, a funnel, and an inverted cartridge casing disposed in alignment and in engagement in that order in a downward direction, the powder in the probe being shown in the process of being transferred to the cartridge casing.

Figure 1:
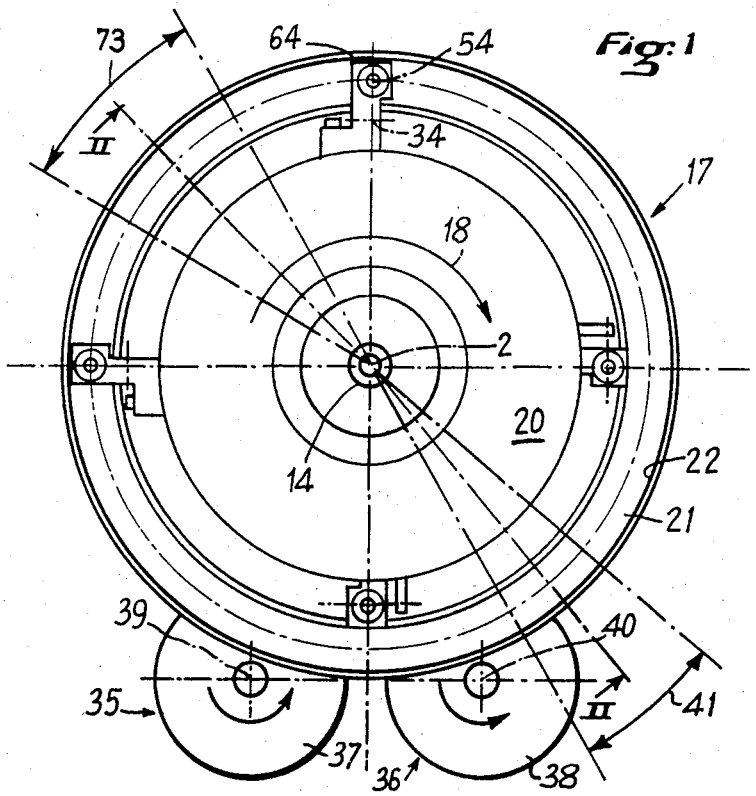
FIG. 1 is a schematic view, from above, of an apparatus according to the invention.
Figure 2:
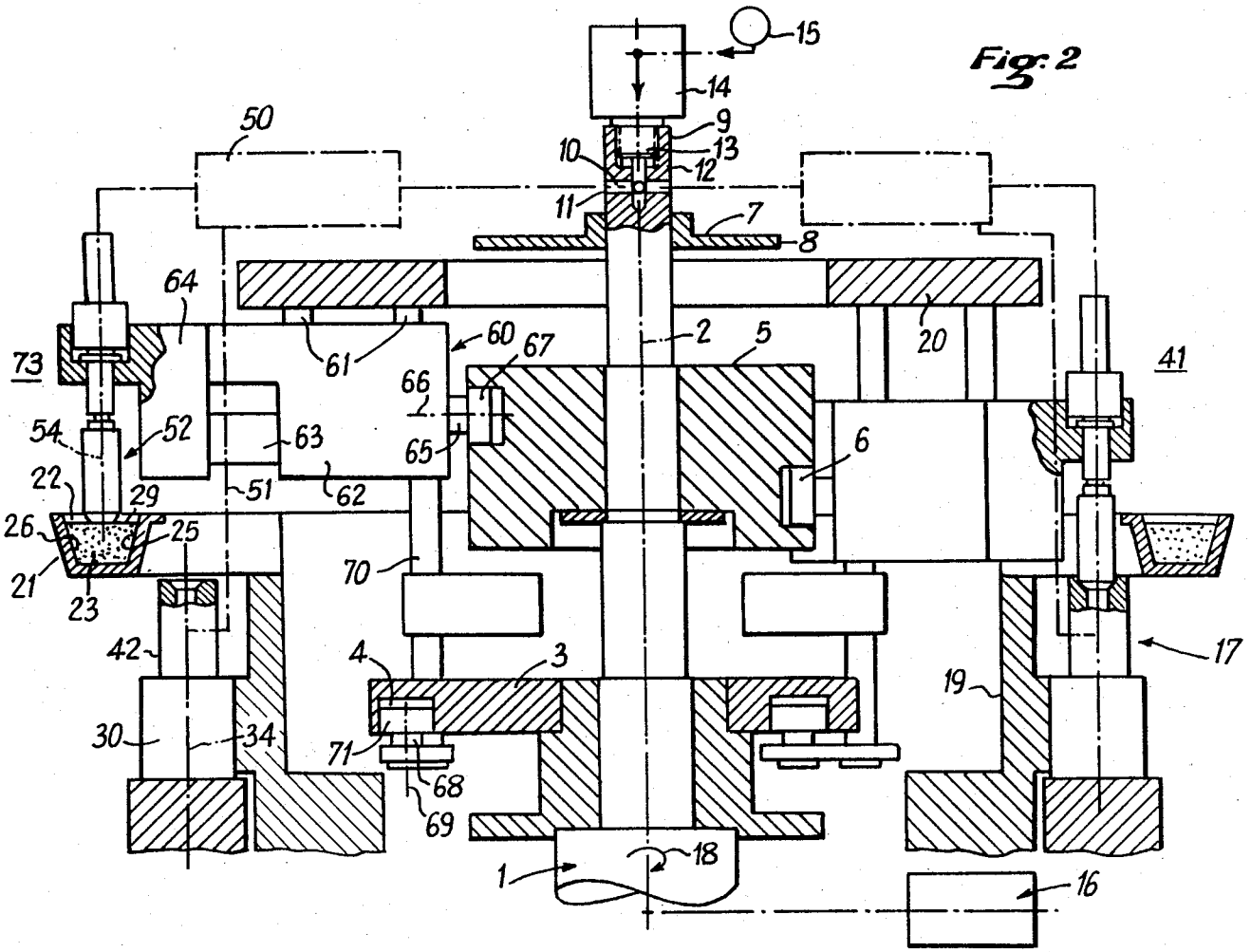
FIG. 2 is a view in vertical section taken along the broken section line 2—2 in FIG. 1.

Turning first to FIGS. 1 and 2, a shaft 1 fixed against rotation and having a vertical axis 2 forms a column; shaft 1 is reduced in diameters in steps in an upwardly direction as shown in FIG. 2. Shaft 1 carries a lower ring 3 in the form of a box cam 4 open to the bottom, an intermediate ring 5 carrying a second box cam 6 which opens to the periphery of the ring 5, and an upper ring 7 having a peripheral cam face 8. A drum 17, mounted for rotation by means (not shown) coaxial of axis 2 of shaft 1 revolves around the column and thus shaft 1 in a clockwise direction as indicated by the arrow 18 in FIG. 1, and by the arrow head to the right and the arrow tail to the left in FIG. 2. Drum 17 includes a lower annular member 19 affixed thereto and disposed generally at the level of the lower ring 3, drum 17, and an upper ring 20 disposed at a level intermediate between that of the rings 5 and 7 of the column 1. Rings 19 and 20 present a form which is generally one of revolution about the axis 2. Drum 16 is driven by means of a motor of known type schematically shown at 16. Above the ring 7, column 1 presents an upper extremity 9 defining a fixed part of a pneumatic distributor with respect to which a rotary part thereof turns. The fixed part of the distributor has cross passage 10 in number 9, passage 10 having discharge extremities 11 in the peripheral external face 12 of the column 1. A face 13 of the rotary part of the rotary distributor mates with the peripheral face 12, the mating faces 12 and 13 being cylinders of revolution about the axis 2. The rotary part of the pneumatic distributor is turned in he direction 18 in synchronism with the drum 17 by means (not shown) fixedly connecting it to the drum. The rotary part of the distributor is connected by a rotary connection of fitting 14 which connects it to a source of pressure air 15.

At its upper level, approximately at the lower level of the intermediate ring 5 of the column 1, the lower ring 19 of the drum 17 carries fixedly connected thereto a radially outer ring 21, in the form of a body of revolution co-axial with the axis 2. Ring 21 is provided with an upwardly open annular channel 22 of downwardly converging cross-section for the reception of powder, channel 22 being in the form of a surface of revolution co-axial with the axis 2.

The channel 22 is fed with powder 23 by a hopper 24 (FIG. 3A) fixed with respect to the column and shaft for the machine in a zone which can be freely chosen, if it is not already located angularly with reference to axis 2, outside a zone 73 wherein powder is removed from channel 22, said zone 73 being fixed with respect to the shaft 1 of the machine; zone 73 will be described below.

As is shown in FIG. 3A, the hopper 24 charges the channel 22 in the direction from its bottom into the interior of the channel 22, through an orifice 27 which is limited by horizontal spaced strips 28 disposed with its lower end at a level above the bottom of the channel 22 but near to such level. The lower end 25 of the outer enclosure part of the hopper closely engaged the inner sidewall 26 of the channel 22; the travel of the channel 22 under the orifice 27 of the hopper 24 during the rotation of the drum 17 in the direction 18 about the column 1 feeds the channel 22 with powder 23 while assuring a constant horizontal level 29 of the powder 23 in the channel 22 between the borders of the orifice 27 of the hopper 24.

The hopper 24 may be advantageously located in advance thereof and upstream of the zone 73 with reference to the direction 18. A comb 72 (FIG. 3A) fixed with respect to the shaft 1 is engaged in the channel 22 at a maximum section thereof in a radial axial plane including the axis 2; the comb sweeps the powder 23 in the channel 22 as it passes by the comb in order to homogenize it and to ensure a constant apparent uncompressed density thereof.

At a level lower than that of the ring 21, the lower ring 19 of the drum 17 carries fixed thereto a predetermined number (four in the illustrative example), of emplacements or stations 20 for the reception of articles 31 adapted to receive powder therewithin in a position in which such object 31 presents toward the top an pending 32. When in a station 30 an object 31 is then fixed with respect to the drum 17.

The manner of providing such station 30 for reception of an object 31 depends upon the nature of such object, and the provision thereof is within the realm of aptitudes of one skilled in the art. In FIG. 4C the object 31 is shown in the form of a cartridge case, and the emplacement or station for the reception thereof upon a turning drum has already been described. For example, in the U.S. patent application No. 564,093, filed Dec. 21, 1983, of the present inventor, particularly with reference to FIGS. 3-5, inclusive, of such document to which one can refer in order to arrive at the design of station 30.

A specific description of station 30 is thus not necessary; it is simply shown schematically herein as having an axis 54 which is fixed with respect to the axis 2 of the shaft 1, with which the axis 33 of an object 31 coincides when the object is received and held fixedly in a station 30. The axes 54 are disposed according to a circular cylinder of revolution around the axis 2, and are uniformly spaced angularly with reference to such axis to, at 90° with respect to each other in the non-limiting example in which there are provided four locations 30.

It should be noted that the emplacements or stations 30, and particularly the axes 54 thereof, are disposed nearer to the axis 2 than the ring 21, and particularly the channel 22 thereof.

In the course of the rotation of the drum 17 about the axis 2 with respect to the column 1, each station 30 for the reception of an object 31 is led successively to a station 35 (FIG. 1) which feeds an article (a cartridge case) to the said station 30, the opening 32 of article 31 being turned upwardly and the article being disposed with its axis 33 vertical. The article 31 then proceeds with the drum 17 to an article filling station having an axis 54 to a discharge station 36 where objects which have received powder are removed from the apparatus. The practical manner of making the feeding station 35 and the discharge station 36 is in the domain of the normal aptitude of one skilled in the art, each of said stations being advantageously constituted by a respective transfer wheel 37, 38, mounted for rotation around a respective vertical axis proper 39, 40, fixed with respect to the shaft 1 of the machine. The wheels 37, 38 rotate in a direction opposite the direction 18 of rotation of the drum 17. This technique is well known, and is described for example in the U.S. patent application No. 564,093, above cited.

It should be noted that the feeding station 35 and the discharge station 36 are near each other, and that the rotation of the drum 17 in the direction 18 around the axis 2 with respect to the column 1 successively passes each reception station 30 to the feeding station 35, then into the zone 73 of feeding the powder 23 into the channel 22, then into the zone 41 wherein the thus provided powder is fed into an object 31 when the reception station 30 passes under the powder feeding station (FIG. 5), such filling zone being located in a zone 41 (FIG. 1) being fixed with respect to the shaft 1 of the machine; the article 31 then finally travels to the discharge station 36.

Above each of the stations 30 for receiving an object 31, the drum 17 carries fixedly with respect thereto a respective funnel 42 having an axis 34, more particularly shown in FIG. 5.

The funnel 42 is generally in the form of a sleeve or muff having a vertical central channel 43 therein, channel 43 having an axis 34. Said channel 43 presents a lower part 44 having a constant transverse section and corresponds substantially to the transverse section of the opening 32 of the object 31, in order, in effect, to prolong such opening 32 upwardly when an object 31 occupies the respective reception station 30, and an upper end portion 45 which is advantageously provided with a downwardly converging frusto-conical seat 46, having an axis 34 lying on the axis 54. When, as in the case when the object 31 is constituted by a cartridge casing, the opening 32 therein is in the form of a transverse surface of revolution about the axis 33, the channel 43 itself advantageously has a similar shape, the portion 44 thereof being a cylinder of revolution around the axis 34 with a diameter equal to that of the opening 32 or possibly slightly inferior to the latter, and the upper portion 45 then presenting a frusto-conical opening or seat 46 of revolution about the axis 34, the connection with the portion 44 defining the smaller base of the frustrum of the cone.

Advantageously, the funnel 42 is provided at the bottom with a revetment or gasket 47 proper to receive the periphery 48 of the opening 32 of the object 31 which occupies the station 30 under consideration, to assure a tight fit between the interior of object 31 and the channel 43.

Finally, advantageously, into the portion 44 of the channel 43 there discharges a conduit 49 proper which is to be connected to the means permitting the establishment of a sub-atmospheric pressure in the channel when the emplacement 30 under consideration is disposed in the filling zone 41, said means forming an integral part of the pneumatic control means 50 (FIG. 2) at each reception station 30, control means 50 being mounted in a fixed manner upon the drum 17. Means 50 are fed with air under pressure via channels 10 in the shaft 1 of the connection or fitting 14 in the zone at the upper end 9 of the column 1, by the intermediary of a distributor which turns around the upper end 9 of the shaft 1, driven by a cam follow roller engaging the peripheral surface 8 of the ring 7, according to an operating cycle which will be described below. Such connection with the pneumatic control means 50 has been shown by phantom lines 51 in FIG. 2.

Every funnel 42 is adapted to assure, at least in the filling zone 41, a tight connection between the object 31 receiving the powder and a powder-dispensing probe or drill 52 of the type which is subjected to sub-atmospheric pressure which is associated with the station 30 under consideration. A number of identical probes 52 identical in number to the number of stations 30 are provided, in order to provide a dosed quantity, in terms of volume, of powder 23 from the channel 22 when the associated station 30 passes the zone 73 during the rotation of the drum 17 in the direction 18 around the column 1, and returns the thus constituted dose of powder to place it in the article 31 which occupies such station 31 during the passage of the latter in the filling zone 41.

This type of probe or drill is well known, and is principally distributed by an American company Perry Industries Inc. It will not be further described other than as shown in a production line with reference to the orientation in which a probe is carried by the drum 17, in a manner which is movable but which preserves nonetheless a predetermined orientation in the apparatus according to the invention.

As shown in FIG. 3B, the probe 52 comprises a tube 53 having a vertical axis 54, said tube 53 being of frustoconical configuration in its lower zone 57, to which it opens to the exterior through an orifice 56 for the retention of the powder deliminated by an annular edge 58 which is very accurately sized and in the shape of a surface of revolution around the axis 54, that is to say here, horizontally. At the transition between the zone 57 and the remainder of the tube 53, the latter is obturated transversely by a porous plate 59 which is adapted to permit the passage of air but is also adapted to retain the powder to be handled. The interior of the zone 57 of the probe, between the porous plate 59 and the orifice 56, defines a volume precisely determined so as itself to form a dose of powder.

Should the occasion arise, the probe 52 may comprise means for permitting the adjustment of the height of the porous plate 59 in the tube 53, or more precisely the distance separating the plate 59 from the lower inner annular edge 58 so as to regulate, in consequence, the volume of the dose of powder to be dispensed therefrom.

Each of the probes 52 thus constituted is carried in the apparatus according to the invention, by the upper ring 20 of the drum 17, and this through the intermediary of means 60, which are mutually independent for each of the probes 52, and are adapted to displace the associated probe 52 in a predetermined manner vertically with respect to the drum 17.

For this purpose, the illustrative means 60 shown in FIG. 3A associated with one probe 52 includes vertical guides 61 solidly affixed to the upper ring 20 of the drum 17 and extending downwardly from the latter, to assure a vertical guiding of the movable equipment 62 which itself carried a horizontal guide 63, directed radially with respect to the axis 2, to guide a radially extending gibbet 64, to which probe 52 is attached. Each of the vertically movable mechanisms 62 is disposed between the intermediate ring 5 and the column 1 and the gibbet 64. Such movable means 62 presents toward the axis 2, that is to say, toward the intermediate ring 5, a stub shaft 65 upon which there is rotatably mounted, around a radial axis 66 fixed with respect to the movable mechanism 62, a cam follower roll 67 engaged in the cam track 6 in the intermediate ring 5. The course of such cam path 6 traversed by the cam follower roll 67 during the rotation of the drum 17 causes vertical displacements of the movable mechanism 62, and with it the gibbet 64 and the probe 52, all according to a cycle which will be described below.

The gibbet 64 carries a stub shaft 68 (FIG. 2) having a vertical axis, a means 70 connecting in a unique manner the respective positions of the gibbet 64 and of the stub shaft 68 radially with reference to the axis 2, and assuring at all times an immobility of the stub shaft 68 in the vertical direction in spite of the conjoint vertical displacements of the movable mechanism 62 and of the gibbet 64. The construction of such means 70 is within the domain of normal aptitude of the man skilled in the art. The stub shaft 68, directed upwardly under the lower ring 3, carries at the interior of the groove 4 in the latter a cam following roller 71 which, in traveling around such groove 4 during the rotation of the drum 17 around the axis 2 with respect to the column 1, causes the gibbet 64 to be displaced radially, with reference to the axis 2, conforming to a cycle which will be described presently, in the general body of the description of the functioning of the assembly of the mechanism which now follows.

Operation of the Apparatus

The description of such operation will be given with reference to a given reception station 30 and the probe or drill 52 associated therewith, the displacements thereof being described with reference to the rotation of the drum 17.

The positions of the part of the apparatus shown in the left-hand half of the mechanism as shown in FIG. 2 will be considered as the initial state of the apparatus, after a station 30 has passed into the zone 73.

In such initial state, the station 30 is occupied by an object 31 the axis 33 of which coincides with the axis 34, and the opening 32 of which, turned toward the top, is in air-tight communication with the channel 43 of the funnel 42 associated with the station 30. The probe 52 is then in a first, lower position in which its axis 54, fixed with respect to the gibbet 64, is disposed in alignment with the annular channel 22, between the edges opposite upper thereof, by reason of the cooperation between the cam following roller 71 and the first track of the cam 4, and in which the probe 52 plunges to place its lower orifice 56 within the channel 22, and more precisely into the powder 23 in the interior thereof, by reason of the cooperation between the cam following rollers 57 and the second path of the cam 6. By reason of the pneumatic control means 50 commanded by the third path of the cam 8, the interior of the probe 52 is subjected to sub-atmospheric pressure, selected so that the probe 52 sucks powder 23 from the channel 22 into the interior of the zone 57 of the probe 52 between the porous plate 59 and the lower edge 58 of the orifice 56, so as to fill zone 57 with powder, thereby to define or measure a dose of powder. Such first position of the zone 57 of the probe is illustrated in phantom lines at A in FIG. 3B.

When, by reason of the rotation of the drum 17 in the direction 18 with respect to the column 1, the station 30 under consideration emerges from the premeasuring zone 73, this movement carries the probe 52 from the first elevated position thereof shown at B in FIG. 3B to the second elevated position thereof shown in phantom lines at C in FIG. 3C, in which the orifice 56 of the probe is disposed above the funnel 42, and in which the axis 54 of the probe coincides with the axis 34 of the funnel, with which the axis 33 of the object 31 also coincides; the sub-atmospheric pressure in the probe 52 is always maintained during these movements thereof.

Then, because of the continuation of the rotation of the drum 17 in the direction 18 with respect to the column 1, the cooperation between the cam following roller 67 and second path of the cam 6 causes a vertical lowering movement of the movable assembly of mechanism 62—gibbet 64—probe 52, whereas the cooperation between the cam following roller 71 and the first half of the cam 4 maintains the gibbet 64 and the probe 52 immovable with respect to the movable mechanism 62; such movement carries the probe 52 as far as the second lower position shown at D in FIG. 3C as well as in the right part of FIG. 2, a position in which the zone 57 of the probe 52 is engaged in the upper end recess 45 of the funnel 42, with which it establishes an airtight connection by reason of the mating of surfaces 46, 57 to form a joint; in the course of such movement, the sub-atmospheric pressure in the probe 52 is still maintained, as has been continuously since the probe entered the premeasuring zone 73.

The station 30 then enters into the filling zone 41 (shown at the right in FIG. 2); during the whole of such travel of station 30 the cooperation of the cam following rollers 71 and 67 with the paths of the cams 4 and 6, respectively, assures an immobility of the probe 52 with respect to the drum 17 in the position D which will now be described. However, at the entrance into the filling zone 41, the cooperation of the third track of the cam 8 and the pneumatic control means 50 cuts off the sub-atmospheric pressure in the interior of the probe 52, in which there can be finally created a super-atmospheric pressure after all of the dose of powder to be dispensed has been discharged into the article or receptacle 31. Incidentally, the described cooperation of the third cam path 8 and the pneumatic control means 50 establishes a sub-atmospheric pressure in the conduit 49 (FIG. 3C), so that the dose of powder contained in the zone 57 of the probe 52 falls into the receptacle 31 by means of the channel or passage 43 in the funnel 42; the sub-atmospheric pressure established in the conduit 49 should be sufficient to facilitate the evacuation, from the assembly formed by the interior of the receptacle 31 and by the passage 43, of air which is introduced because of the introduction of the dose into the receptacle 31. It is also by preference sufficient to entrain the dust disengaged by the fall of the dose of powder; this should not, however, disturb the passage of the powder from the probe 52 to the interior of the article 31.

When the station 30 leaves the filling zone 41, the rotation of the drum 17 in the direction 18 with respect to the column 1 continues, the super-atmospheric pressure in the interior of the probe 52 is cut off as well as the sub-atmospheric pressure in the conduit 49, and the cooperation of the cam following roller 67 with a second path of the cam 6 causes a raising of the movable assembly of mechanism 62—gibbet 64—probe 52 from the position D to the position C. The cooperation of the cam following roller 71 with the first path of the cam 4 always maintains the axis 54 of the probe 52 at a uniform distance vis-a-vis the axis 2. In the course of such movement, the station 30 to the article discharge or return means 36, where the article 31 which has now been provided with powder, is returned by the transfer wheel 38 to be led away to other operations, such mode of return of an object upon a drum being known per se.

During the rotation of the drum 17 in the direction 18 around the column 1, a station 30 passes to the feeding station 35 where the transfer wheel 37 puts into place a new, empty article or receptacle 31, in the position in which its axis 33 coincides with the axis 34 of the funnel 42 and in which the opening 32 of such receptacle is disposed at the top. On the other hand, the cooperation of the cam following roller 71 with the first path of the cam 4 brings back the probe 52, by relative movement of the gibbet 64 and the movable means 62, from the position C to the position B without variation of the level by reason of the cooperation between the cam following roller 67 and the second path of the cam 6; then, the cam following roller 71 cooperates with the first path of the cam 4 in order to immobilize the axis 54 in its position corresponding to the position B. The cooperation of the roller 67 with the second path of the cam 6 returns the probe 52 from the position B to the position A, later than the station 30 enters into the dispensing zone 73.

The cycle described above begins again, by preweighing the powder by the use of the passage 23, the probe 52, etc. . . . ; between two passages of the same station 30 through the preweighing zone 73, the level 29 of the powder 23 in the channel 22, and more precisely in the zone of the latter by which the probe 52 associated with such station preweighs powder, is reestablished by the hopper 24, which is preferably disposed outside the preweighing zone 73.

The form to be given to the paths of the cams 4, 6, and 8 and the manner of constructon of the pneumatic control 50 can be easily determined by one skilled in the art as a function of the description of the manner of their cooperation; the purely mechanical character of the control of the different motions and the control of the phases of sub-atmospheric pressure in the probe 52 and in the conduit 49 and the eventual placing under pressure of the probe 52, permits the total exclusion of electrical controls, and, as a consequence, there is provided a mechanism according to the invention which can offer total guaranty of safety itself in an explosive atmosphere.

Naturally, one skilled in the art can provide numerous variations of the mechanism which has been described above without departing from the scope of the teaching of the present invention.

Notably, in lieu of being carried in a fixed manner by the drum 17, the channel or passage 22 can be driven in rotation, by specific driving means, around the axis 2 at a speed which is different from that of the drum, in particular, in the same direction 18 and at a lower speed; it may also be fixed with respect to the shaft 1 of the machine, in which case one skilled in the art can provide appropriate means, different from the fixed hopper described, for feeding the powder 23.

The introduction of a differential speed between the annular channel 22 and the drum 17 permits, in particular, the assurance of a weighing of the powder at different points in the channel.

In order further to guarantee a precise measurement of the dose of powder premeasured by the probe 52 and to introduce into the object 31, one may advantageously provide an element adapted to scrape the excessive powder retained on the exterior of the zone 57 of the probe 52 formed between the plate 59 and the orifice 56. One such element may be disposed, as shown schematically at 74 in FIG. 3, projecting upwardly, on the circular edge radially interiorly of the passage 22, the free horizontal upper edge of such element being contained in the plane defined by the lower annular edge 58 of the probe in the course of movement thereof from the position B to the position C shown in FIG. 3C.

It is to be understood that the eventual excess of powder separated from the probe 52 by its being scraped by the element 74 falls into the annular passage 22. The element 74 will by preference be formed as a rubber scraper so as not to abrade or otherwise injure, the probe 52, or to strike a spark by rubbing against any other part of the apparatus.

In the case in which the annular channel 22 is movable with respect to the drum 17, the scraping element 74 will be disposed upon the entire periphery of the circular radially interior edge of the channel 22.

To the contrary, when the channel 22 is fixed to the drum 17, the scraping element 74 will be limited to angular sectors suitably disposed with respect to the location of the powder-dispensing probes.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. Apparatus for the volumetric dosing of a powder and for introducing predetermined doses of the same into hollow objects, comprising:

a drum mounted for rotation about a vertical axis on a shaft, means to drive the drum in continuous rotation in a predetermined direction, with respect to the shaft around the said axis, means on the drum presenting an annular channel for the reception of powder, said channel being open at the top and presenting a shape of revolution around the said axis of rotation of the drum, means for feeding the annular channel with powder and maintaining the powder at a constant level therein, a predetermined number of receiving stations each for the reception of a hollow object occupying a position in which an opening thereof is directed upwardly and positioned on a predetermined vertical axis, the said stations being fixed on the drum with respect thereto and uniformly spaced annularly around the axis of rotation thereof, forming a ring about such axis and disposed closer to such axis than the annular channel, a feeding post for feeding the receiving stations with objects occupying the said position, said feeding post being fixed with respect to the shaft, a discharging post for discharging the objects from the receiving stations, such discharging post being fixed with respect to the shafts, the same predetermined number of powder dispensing probes of known vacuum-drawing type carried in a movable manner upon the drum and disposed according to a predetermined orientation in which each presents to the bottom a powder-retaining dispensing orifice having a vertical axis, each of said probes being associated with a receiving station, means for displacing each of the probes with respect to the drum separately and cyclically in synchronism with the rotation thereof with respect to the shaft, according to a fixed trajectory with respect to the drum and presenting the dispensing orifice of the probe in the hereinafter named successive positions following each other:

(a) a first lower position in which such orifice plunges into the annular channel, the probe then occupying an angular position with respect to the shaft, with reference to the axis of rotation of the drum, which is different from that of the means for feeding the annular channel with powder, (b) a first upper position in which the orifice is disposed in line with and above the annular channel, (c) a second upper position in which the orifice is disposed coaxially with the opening of an object occupying said position in the receiving station associated with said probe, said orifice and said opening being separated, (d) a second lower position in which said orifice is disposed coaxially with the opening of such object and in communication therewith, the said receiving station being displaced from the object feeding post to the discharging post by reason of the rotation of the drum with respect to the shaft, (e) then displaced back in the second upper position, and then (f) displaced back in the first upper position, and means at first to cause a sub-atmospheric pressure in said orifice in position (a) and from position (a) to position (d) thereof, and later to cut off said sub-atmospheric pressure in position (d) and from position (d) to position (a), during the rotation of the drum with respect to the shaft.

2. Apparatus according to claim 1, characterized in that the drum carries at least means for tightly connecting the orifice of a probe and the opening of an object in the position (d) of the probe, and means to establish a sub-atmospheric pressure within the object in such position (d) of the probe.

3. Apparatus according to claim 2, characterized in that the means for tightly connecting the orifice of the probe and the opening in the object comprises immediately above each receiving station for a funnel for the reception of the orifice of the probe in said position (d), the probe being engaged in said funnel in said second lower position.

4. Apparatus according to claim 3, characterized in that the means to establish a sub-atmospheric pressure within the object leads into said funnel.

5. Apparatus according to claim 1,characterized in that the operation thereof is accomplished by means which are exclusively mechanical.

6. Apparatus according to claim 1 characterized by the fact that the means for feeding the annular channel with powder comprises a hopper opening inside the channel, and by the fact that means are provided for assuring a circular displacement relative to the axis of rotation of the drum between the annular channel and the hopper.

7. Apparatus according to claim 6, characterized by the fact that the hopper is fixed with respect to the shaft.

8. Apparatus according to claim 1, characterized by the fact that the annular channel for the reception of powder is fixed with respect to the drum.

9. Apparatus according to claim 1, characterized by the fact that it comprises means for driving the annular channel for the reception of powder in rotation with respect to the shaft, around the axis of rotation of the drum with respect to the latter, the driving means driving the annular channel and the drum at different speeds.

10. Apparatus according to claim 1, characterized by the fact that it comprises scraping means disposed on a radially interior circular edge of the channel and having an upper free horizontal edge which coincides with a plane of displacement of a lower free edge defining the orifice of the probe in the course of displacement of the probe from the first upper position thereof toward the second upper position thereof.

* * * * *